US005642126A

United States Patent [19]

Okada et al.

[11] Patent Number: 5,642,126

[45] Date of Patent: Jun. 24, 1997

[54] DRIVING CIRCUIT FOR DRIVING A DISPLAY APPARATUS AND A METHOD FOR THE SAME

[75] Inventors: Hisao Okada, Ikoma-gun; Shigeyuki Uehira, Kashihara; Junji Kawanishi, Nara, all of Japan

[73] Assignee: Sharp Kabushiki Kaisha, Osaka, Japan

[21] Appl. No.: 543,464

[22] Filed: Oct. 16, 1995

Related U.S. Application Data

[63] Continuation of Ser. No. 157,941, Nov. 24, 1993, abandoned.

[30] Foreign Application Priority Data

Nov. 25, 1992 [JP] Japan ..... 4-315422

[51] Int. Cl.[6] ..... G09G 3/16

[52] U.S. Cl. ..... 345/94; 345/89; 345/147; 345/209

[58] Field of Search ..... 345/98, 87, 89, 345/94, 95, 208, 209, 210, 147, 92; 359/59, 55

[56] References Cited

U.S. PATENT DOCUMENTS

| | | | |
|---|---|---|---|
| 5,010,327 | 4/1991 | Wakita et al. | 345/89 |
| 5,408,246 | 4/1995 | Inaba et al. | 345/89 |

FOREIGN PATENT DOCUMENTS

| | | | |
|---|---|---|---|
| 0238287 | 9/1987 | European Pat. Off. . | |
| 0478386A2 | 1/1992 | European Pat. Off. | 345/94 |
| 0478384 | 4/1992 | European Pat. Off. | 345/208 |
| 0515191 | 11/1992 | European Pat. Off. | 345/94 |
| 04070625 | 3/1992 | Japan | 345/95 |
| 04142592 | 5/1992 | Japan | 345/89 |
| 4299388 | 10/1992 | Japan | 345/89 |

OTHER PUBLICATIONS

"Liquid Crystals — Applications And Uses" Copyright 1990 by World Scientific Publishing Co. Pte. Ltd. pp. 349–352.

*Primary Examiner*—Richard Hjerpe
*Assistant Examiner*—Lun-Yi Lao
*Attorney, Agent, or Firm*—David G. Conlin; Peter F. Corless

[57] ABSTRACT

A method for driving a display apparatus is provided which apparatus includes a display section having pixels and switching elements respectively connected to the pixels, and also includes a data driver for driving the display section, and data lines connecting the switching elements to the data driver, the pixels being allowed to produce a display image by specific voltages applied thereto. The method includes the steps of: allowing the data driver to output a non-oscillating voltage signal to each of the data lines during a predetermined time period from the start of one output period; and allowing the data driver to output an oscillating voltage signal to each of the data lines from the end of the predetermined time period until the end of the output period, the oscillating voltage signal including at least one oscillating component.

13 Claims, 8 Drawing Sheets

DRIVING CIRCUIT FOR DRIVING A DISPLAY APPARATUS AND A METHOD FOR THE SAME

This is a Continuation of application Ser. No. 08/157,941 filed Nov. 24, 1993, now abandoned.

BACKGROUND OF THE INVENTION

1. Field of the Invention

The present invention relates to a method for driving a flat panel display apparatus, and also relates to a driving circuit for the display apparatus. More particularly, the invention relates to a method for driving a display apparatus which receives a digital image signal to produce a display image with gray scales in accordance with the received digital image signals, and it also relates to a driving circuit for such a display apparatus.

2. Description of the Related Art

FIG. 1 shows a data driver exemplifying a conventional driving circuit for driving a display apparatus which receives digital image data to produce a display image with gray scales in accordance with the received data. For simplicity of explanation, it is herein assumed that the digital image data consists of two bits ($D_0$, $D_1$). This data driver supplies driving voltages to N pixels (where N is a positive integer) on a scanning line which has been selected by means of a scanning signal.

FIG. 2 shows a circuit constituting part of the data driver of FIG. 1. This circuit, which is denoted by the reference numeral 20, supplies a driving voltage through a data line to the "n"th pixel (where n is an integer of 1 to N) of the above-mentioned N pixels provided along the single scanning line. The circuit 20 includes sampling (primary) flip-flops 21 each for receiving one bit of the digital image data ($D_0$, $D_1$), holding (secondary) flip-flops 22 each also for receiving one bit, a decoder 23 and four analog switches 24 to 27. To the analog switches 24 to 27, signal voltages $V_0$ to $V_3$ are respectively supplied from four different voltage sources. As the sampling flip-flops 21, D flip-flops or various other flip-flops can be used.

The circuit 20 shown in FIG. 2 operates as follows. On receiving the leading edge of a sampling pulse $T_{smpn}$ corresponding to the "n"th pixel, the sampling flip-flops 21 obtain the digital image data ($D_0$, $D_1$) and hold the thus obtained data therein. When such image data sampling for the 1st to Nth pixels on a single scanning line is completed (i.e., sampling corresponding to one horizontal period is completed), an output pulse OE is applied to the holding flip-flops 22. On receiving the output pulse OE, the holding flip-flops 22 obtain the digital image data ($D_0$, $D_1$) from the sampling flip-flops 21, and transfer the thus obtained digital image data to the decoder 23. The decoder 23 decodes each bit of the digital image data ($D_0$, $D_1$), and turns on one of the analog switches 24 to 27 in accordance with the respective values of the thus decoded bits. As a result, one of the signal voltages $V_0$ to $V_3$ from the four different voltage sources, which corresponds to the thus turned-on analog switch 24, 25, 26 or 27, is output from the circuit 20.

A conventional data driver such as described above requires $2^n$ different voltage sources (where n is the number of bits constituting digital image data). In other words, the number of required voltage sources doubles when the digital image data is enlarged by one bit. For example, in the case where the digital image data consists of 4 bits for the generation of a display image with 16 gray scales, the number of required voltage sources is: $2^4$=16. Similarly, in the case where the digital image data consists of 5 bits for the generation of a 32-gray-scale display image, the number of required voltage sources is: $2^5$=32. In the case of 6-bit digital image data for the generation of a 64-gray-scale display image, the number of required voltage sources is: $2^6$=64.

Such voltage sources are connected through the analog switches of the data driver to a display apparatus, e.g., a liquid crystal panel, which provides a heavy load on the voltage sources. Thus, each voltage source is required to have a sufficient performance to drive such a heavy load. The increase in the number of such high-performance voltage sources is a significant factor in the higher production cost of the entire driving circuit. Furthermore, since high-performance voltage sources cannot readily be placed within the LSI circuit constituting the driving circuit, they must be located outside the LSI circuit. This means that signal voltages for driving the liquid crystal panel must be supplied from external voltage sources to the LSI circuit. As a result, with an increase in the number of voltage sources, the number of input terminals of the LSI circuit must be increased accordingly. It is extremely difficult to produce an LSI circuit having such a large number of input terminals. Even if it is possible to make such an LSI circuit, mounting or manufacturing problems arise in the mass production thereof; it is practically impossible to mass-produce such LSI circuits.

To solve the above-described problem, an oscillating voltage driving method and a driving circuit using this method have been proposed by Japanese Patent Application No. 4-129164, which has not been published. In the proposed method and driving circuit, external voltage sources are provided to supply gray-scale reference voltages which are used to further obtain a plurality of interpolated voltages, so that gray scales can be obtained using both the gray-scale reference voltages and the interpolated voltages. Thus, the number of gray scales which can be obtained is larger than that of the voltage sources in the driving circuit. Several types of data driver using this oscillating voltage driving method have been put into practical use.

FIG. 3 shows a circuit 30 constituting part of a data driver exemplifying the proposed driving circuit using the above-described oscillating voltage driving method. In the circuit 30, four interpolated voltages $(V_0+2V_2)/3$, $(2V_2+V_5)/3$, $(V_2+2V_5)/3$ and $(2V_5+V_7)/3$ can be obtained from four gray-scale reference voltages $V_0$, $V_2$, $V_5$ and $V_7$ which are supplied from external voltage sources. From the four gray-scale reference voltages and the four resultant interpolated voltages, eight gray scales are obtained. Thus, the provision of only four voltage sources for supplying gray-scale reference voltages makes it possible to obtain eight gray scales.

FIG. 4 shows, by way of example, the waveform of a signal voltage $V_1$ which is output to a data line from the circuit 30 of FIG. 3, and the waveform of a signal voltage $V_{COM}$ applied across a common electrode (not shown) of a liquid crystal panel which is driven by this conventional data driver in accordance with a known alternating driving method. It is assumed in FIG. 4 that the entire driving circuit operates under the ideal condition of no load. The signal voltage $V_1$ is one of the four interpolated voltages described above, which is produced from the gray-scale reference voltages $V_0$ and $V_2$ in the case where the value of the digital image data is 1. Voltages $V_1^+$ and $V_1^-$ indicate voltages applied to a pixel in a positive period (field) and in a negative period (field), respectively. The waveforms of the gray-scale reference voltages $V_0$ and $V_2$ are shown in FIG. 5, for comparison with the signal voltage (interpolated voltage)

$V_1$. As shown in FIG. 4, the signal voltage $V_1$ periodically oscillates between the two gray-scale reference voltages $V_0$ and $V_2$ in such a manner that the ratio of the total time for $V_0$ to that for $V_2$ in one output period is 1:2. A voltage such as this signal voltage $V_1$, which periodically oscillates between two different voltages, is known as an oscillating voltage.

This conventional data driver operates in accordance with a so-called "line inversion method" in which the polarity of signal voltages is changed from positive to negative or vice versa at the beginning of each horizontal period, thereby preventing the deterioration of the liquid crystal device. One output period is usually set equal to one horizontal period.

FIG. 6 shows a power supply circuit 60 for supplying the above-mentioned gray-scale reference voltages $V_0$ and $V_2$ to the data driver. The power supply circuit 60 includes operational amplifiers 61 and 62. The oscillating voltage $V_1$ in FIG. 4 can be obtained by allowing the power supply circuit 60 to alternately output the two gray-scale reference voltages $V_0$ and $V_2$ during one output period.

In the above-described conventional data driver using the oscillating voltage driving method, a plurality of interpolated voltages are obtained from the gray-scale reference voltages, so that a large number of gray scales can be obtained by the use of a limited number of voltage sources. This conventional data driver, however, involves such problems as will be described below.

FIG. 7 shows an equivalent circuit of a data line which is connected to the data driver and accordingly provides a load on it. In a data line actually used, capacitance and resistance exist as distributed constants. On the other hand, with a data line considered as a load, such capacitance and resistance can be considered simply as concentrated constants $R_S$ and $C_S$. For example, the concentrated constants $R_S$ and $C_S$ may be set to 50 kΩ and 100 pF, respectively.

A single data line such as described above provides only a light load. But the number of the data lines used in a liquid crystal panel is so large that the total load provided by the data lines becomes significant. For example, in a VGA-compatible liquid crystal panel, the number of its data lines is: 640×3=1920. If all the values of digital image data corresponding to a single horizontal (scanning) line are 1, 1920 circuits identical to the circuit 30 of FIG. 3 output oscillating voltages $V_1$ to the 1920 data lines respectively connected thereto. Due to the application of the oscillating voltage $V_1$ to all the 1920 data lines, 1920 such equivalent circuits as shown in FIG. 7 function together as a load on the power supply circuit 60 of FIG. 6. In this case, if the sum of the absolute values of potential differences $V_1^+$ and $V_1^-$ each between the oscillating voltage $V_1$ and the voltage $V_{COM}$ applied to a common electrode shown in FIG. 4 is 10 V, the maximum current flowing through the power supply circuit 60 is: (10 V/50 kΩ)×1920=400 (mA). Such a high-scale current flows through the power supply circuit 60 immediately after the voltage polarity has been reversed, i.e., at the beginning of one output period. Thus, the entire driving circuit is in a transient state in the initial part of one output period. In such a transient state, when the output voltage from the power supply circuit 60 is switched from one gray-scale reference voltage to another (e.g., from $V_0$ to $V_2$) and vice versa at a high speed to obtain an oscillating voltage (e.g., $V_1$), parasitic oscillation is very likely to arise in the power supply circuit 60 due to the high-scale current flowing therethrough. As a result, the operation of the power supply circuit 60 is prone to be unstable.

FIG. 8 shows an example of the waveform of the gray-scale reference voltage $V_0$ supplied from the power supply circuit 60 in which parasitic oscillation has occurred. This unnecessary parasitic oscillation causes problems such as an increase in power consumption and generation of heat in the power supply circuit 60.

A possible way to prevent such parasitic oscillation is to decrease the slewing rates of the operational amplifiers 61 and 62 of the power supply circuit 60. The decrease in the slewing rates, however, deteriorates the characteristics of the entire driving circuit, such as its current response characteristics or rise time.

SUMMARY OF THE INVENTION

According to one aspect of the invention, a method for driving a display apparatus which includes a display section including pixels and switching elements respectively connected to the pixels, and also includes a driving circuit for driving the display section, and signal lines connecting the switching elements to the driving circuit, the pixels being allowed to produce a display image by specific voltages applied thereto is provided. The method includes the steps of: allowing the driving circuit to output a non-oscillating voltage signal to each of the signal lines for a predetermined time period from the start of one output period; and allowing the driving circuit to output an oscillating voltage signal to each of the signal lines from the end of the predetermined time period until the end of the output period, the oscillating voltage signal including at least one oscillating component.

In one embodiment of the invention, the predetermined time period includes a period of time during which the driving circuit remains in a transient state, the transient state of the driving circuit arising at the start of the output period.

In another embodiment of the invention, the oscillating voltage signal periodically oscillates between a first voltage and a second voltage.

According to another aspect of the invention, a driving circuit for a display apparatus which includes a display section including pixels and switching elements respectively connected to the pixels, and also includes signal lines connected to the switching elements, the pixels being allowed to produce a display image by specific voltages applied thereto is provided. The driving circuit includes: a voltage signal output control means for outputting a non-oscillating voltage signal to each of the signal lines for a predetermined time period from the start of one output period, and then outputting an oscillating voltage signal to each of the signal lines from end of the predetermined time period until the end of the output period, the oscillating voltage signal including at least one oscillating component.

In one embodiment of the invention, the predetermined time period includes a period of time during which the driving circuit remains in a transient state, the transient state of the driving circuit arising at the start of the output period.

In another embodiment of the invention, the oscillating voltage signal periodically oscillates between a first voltage and a second voltage.

In still another embodiment of the invention, the voltage signal output control means includes: a plurality of switching means; and a selective control circuit for receiving digital image data and then turning on or off the switching means individually to control the on/off state thereof in accordance with the received digital image data, and wherein the switching means allow, only when they are turned on, different voltage signals respectively supplied thereto to be delivered to each of the signal lines, and the selective control circuit turns on one of the switching means to keep the switching means in the on state during the predetermined time period, and then controls the on/off state of at least one pair of the switching means to alternately turning them on from the end of the predetermined time period until the end of the output period.

Thus, the invention described herein makes possible the advantages of (1) providing a method for driving a display apparatus, which method enables rapid switching of gray-scale reference voltages, without causing any parasitic oscillation in a power supply circuit, and also without any deterioration in the characteristics of a driving circuit, such as its current response characteristics or rise time; and (2) providing a driving circuit which drives a display apparatus in accordance with such a method.

These and other advantages of the present invention will become apparent to those skilled in the art upon reading and understanding the following detailed description with reference to the accompanying figures.

DESCRIPTION OF THE PREFERRED EMBODIMENTS

The invention will now be further described by reference to examples. A matrix-type liquid crystal display apparatus is herein used as a display apparatus to be driven by a method and a driving circuit according to the invention. But it is understood that the method and driving circuit of the invention can also be applied to other types of display apparatus.

Figure 9:
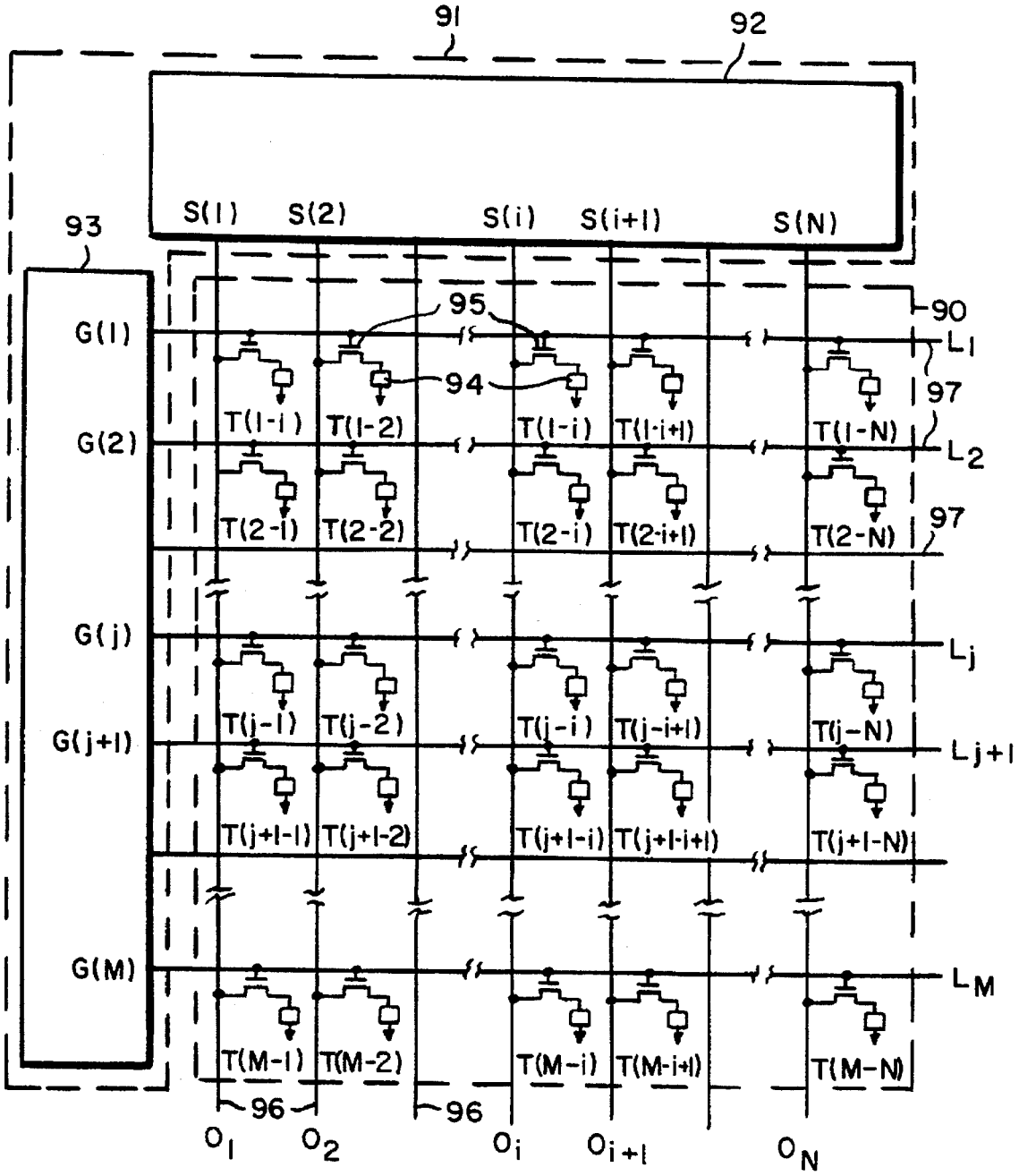
FIG. 9 is a schematic diagram showing a liquid crystal display apparatus to be driven by a method and a driving circuit according to the invention.

FIG. 9 is a schematic diagram showing the configuration of a matrix-type liquid crystal display apparatus to be driven by a method and a driving circuit according to the invention. The liquid crystal display apparatus includes a display section 90 for displaying an image thereon, and a driving circuit 91 for driving the display section 90. The driving circuit 91 includes a data driver 92 and a scanning driver 93 which provide image signals and scanning signals, respectively, to the display section 90. The data driver is also sometimes referred to as a source driver or column driver. The scanning driver is also sometimes referred to as a gate driver or row driver.

The display section 90 includes an M×N array of pixels 94 (M pixels in each column and N pixels in each row; where M and N are positive integers), and also includes switching elements 95 respectively connected to the pixels 94.

The data driver 92 is provided with N output terminals S(i) (where i is an integer of 1 to N) each of which corresponds to one of the N columns of M switching elements 95. The N output terminals S(i) are respectively connected to the corresponding switching elements 95 by means of N data lines 96. Similarly, the scanning driver 93 is provided with M output terminals G(j) (where j is an integer of 1 to M) each of which corresponds to one of the M rows of N switching elements 95. The M output terminals G(j) are respectively connected to the corresponding switching elements 95 by means of M scanning lines 97. As the switching elements 95, thin film transistors (TFTs) can be used. Alternatively, other types of switching elements may also be used. The data line is also sometimes referred to as a source line or column line. The scanning line is also sometimes referred to as a gate line or row line.

The scanning driver 93 outputs high-scale voltages sequentially from its output terminals G(j) to the corresponding scanning lines 97, in such a manner that the level of the voltage output from each output terminal G(j) is kept at a high level for a specific period of time. This specific time period is designated as one horizontal period jH (where j is an integer of 1 to M). The total length of time obtained by adding up all the horizontal periods jH (i.e., 1H+2H+3H+ . . . +MH) is designated as one vertical period.

When the voltage applied to one of the scanning lines 97 (i.e., the "j"th scanning line) from the output terminal G(j) of the scanning driver 93 is changed from a low level to a high level, the switching elements 95 connected via the scanning line 97 to the output terminal G(j) are turned on. While the switching elements 95 are kept in the on state, the pixels 94 respectively connected thereto are charged in accordance with voltages supplied to the corresponding data lines 96 from the output terminals S(i) of the data driver 92. The voltages of the thus charged pixels 94 remain unchanged for about one vertical period until they are charged again by the subsequent voltages to be supplied from the data driver 92.

Figure 10:
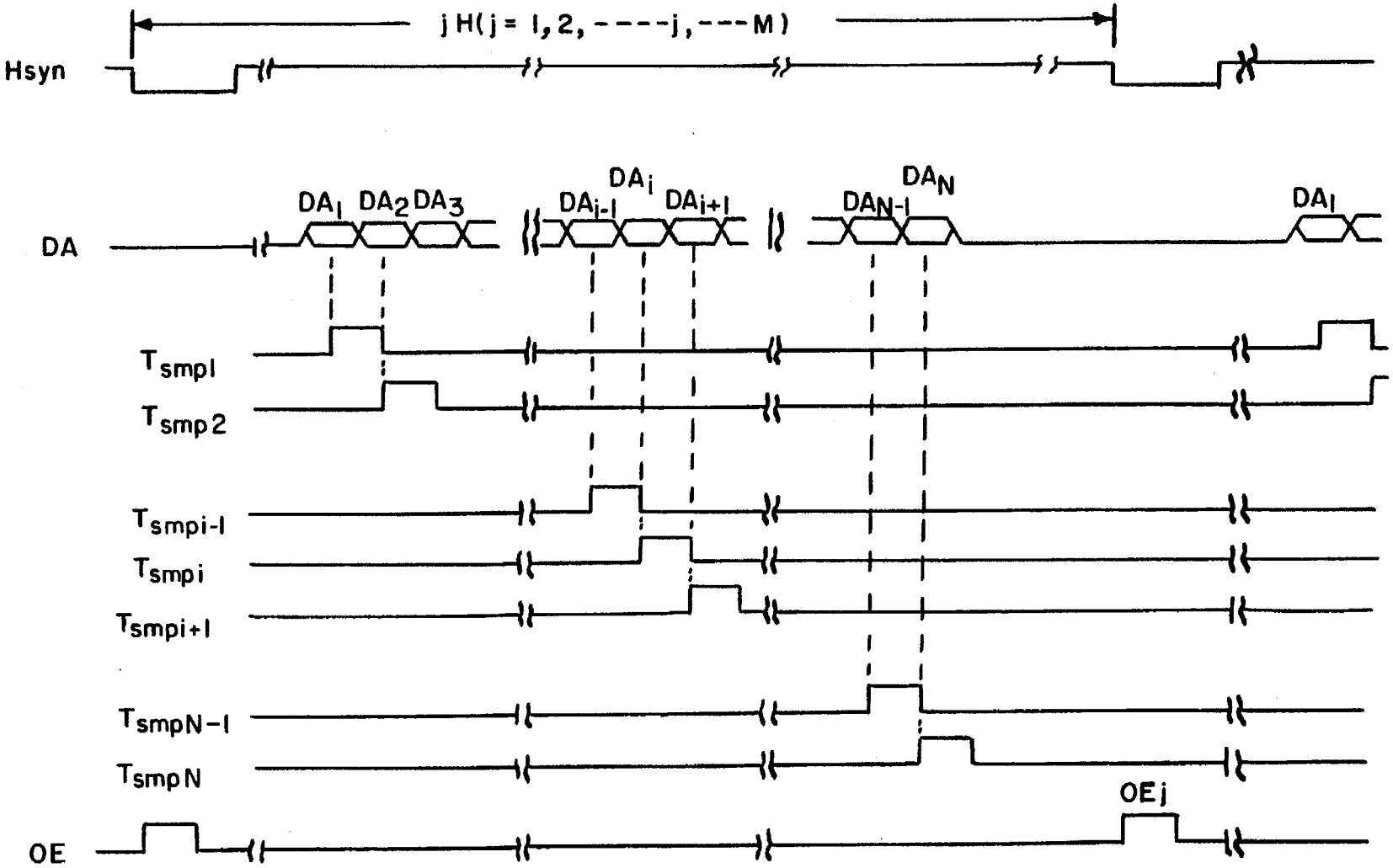
FIG. 10 is a timing chart showing the relationship among signals during one horizontal period.

FIG. 10 shows the relationship among digital image data DA, sampling pulses $T_{smpi}$, and an output pulse signal OE, during the "j"th horizontal period jH determined by a horizontal synchronizing signal $H_{syn}$. As can be seen from FIG. 10, while sampling pulses $T_{smp1}$, $T_{smp2}$, . . . , $T_{smpi}$, . . . , $T_{smpN}$ are sequentially applied to the data driver 92, digital image data $DA_1$, $DA_2$ . . . , $DA_i$ . . . , $DA_N$ are fed into the data driver 92 accordingly. The "j"th output pulse $OE_j$ determined by the output pulse signal OE is then applied to the data driver 92. On receiving the "j"th output pulse $OE_j$, the data driver 92 outputs voltages in accordance with the digital image data $DA_1$ to $DA_N$, respectively from its output terminals S(1) to S(N) to the corresponding data lines 96.

Figure 11:
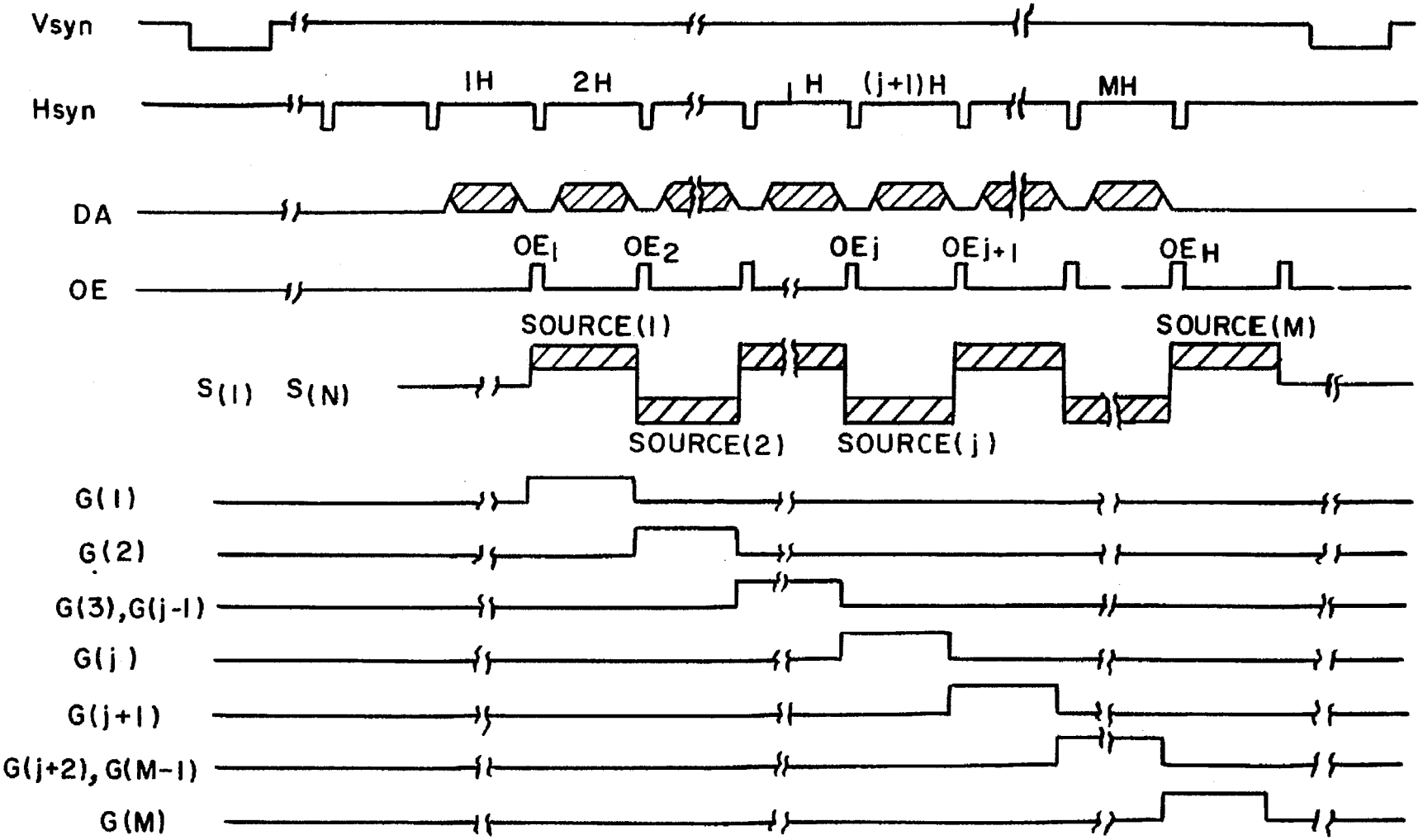
FIG. 11 is a timing chart showing the relationship among signals during one vertical period.

FIG. 11 shows the relationships among the horizontal synchronizing signal $H_{syn}$, the digital image data DA, the output pulse signal OE, and the timing of voltage supply from the data driver 92 and scanning driver 93, during one vertical period determined by a vertical synchronizing signal $V_{syn}$. In FIG. 11, a SOURCE (j) indicates the levels of voltages output from the data driver 92, with such timing as shown in FIG. 10 and in accordance with the N sets of digital image data DA which have been fed into the data driver 92 during the "j"th horizontal period jH. The SOURCE (j) is shown as a hatched rectangular area to indicate a range of voltages output from all the N output terminals S(1) to S(N) of the data driver 92. While the voltages indicated by the SOURCE (j) are applied to the data lines 96, the voltage supplied from the scanning driver 93 through its output terminal G(j) to the "j"th scanning line 97 is changed to and kept at a high level, thereby turning on all the N switching elements 95 connected to the "j"th scanning line 97. As a result, the N pixels 94 respectively connected to these N switching elements 95 are charged in accordance with the voltages applied to the corresponding data lines 96 from the data driver 92.

The above-described process is repeated M times, i.e., for the 1st to Mth scanning lines 97, so that an image corresponding to one vertical period is displayed. In the case of a non-interlace type display apparatus, the thus produced image serves as a complete display image on the display screen thereof.

The time interval between the rise of the "j"th output pulse $OE_j$ and the rise of the "j+1"th output pulse $OE_{j+1}$ in the output pulse signal OE is herein designated as one output period. This means that one output period is equal to the duration of each SOURCE (j) shown in FIG. 11. In cases where ordinary linear sequential scanning is performed, one output period is made equal to one horizontal period. The reason for this is as follows: While the data driver 92 outputs, to the data lines 96, voltages corresponding to digital image data for one horizontal (scanning) line, it also performs sampling of digital image data for the next horizontal line. The maximum length of time during which these voltages can be output from the data driver 92 is equal to one horizontal period. Furthermore, except for special cases, as the output period becomes longer, the pixels can be charged more accurately. In the driving circuit described herein, therefore, one output period is equal to one horizontal period. According to the invention, however, one output period is not necessarily required to be equal to one horizontal period.

The data driver 92 of the driving circuit 91 shown in FIG. 9 is presented as an example of the driving circuit according to the invention, which will be described in detail below by reference to FIGS. 12 to 14.

Figure 12:
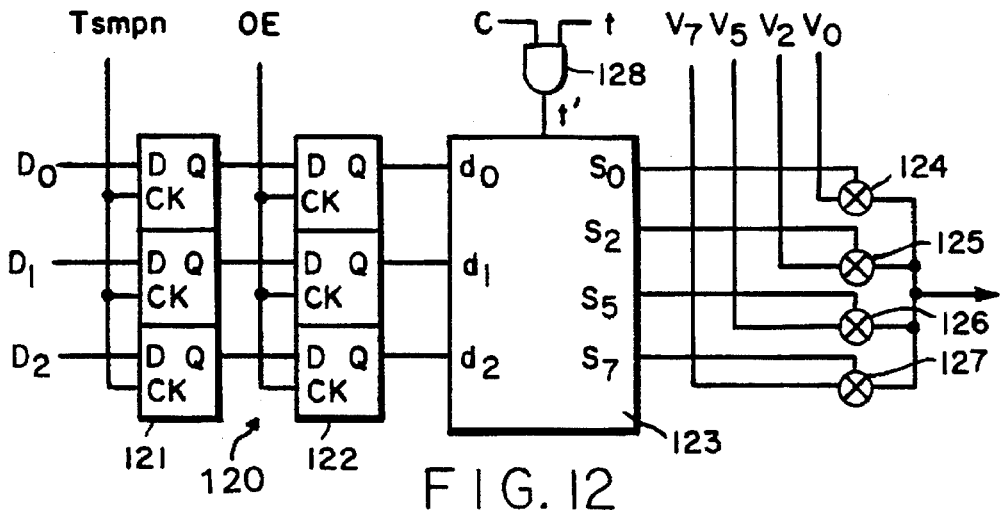
FIG. 12 is a schematic diagram showing a circuit which constitutes part of a data driver 92 shown in FIG. 9.

FIG. 12 shows one of N identical circuits 120 in the data driver 92. N circuits 120 supply signal voltages respectively through the N output terminals S(1) to S(N) of the data driver 92 to the corresponding data lines 96. The circuit 120 outputs a signal voltage through the "n"th output terminal S(n) to the corresponding data line 96 (where n is an integer of 1 to N). In this example, digital image data consists of three bits ($D_0$, $D_1$, $D_2$).

Figure 1:
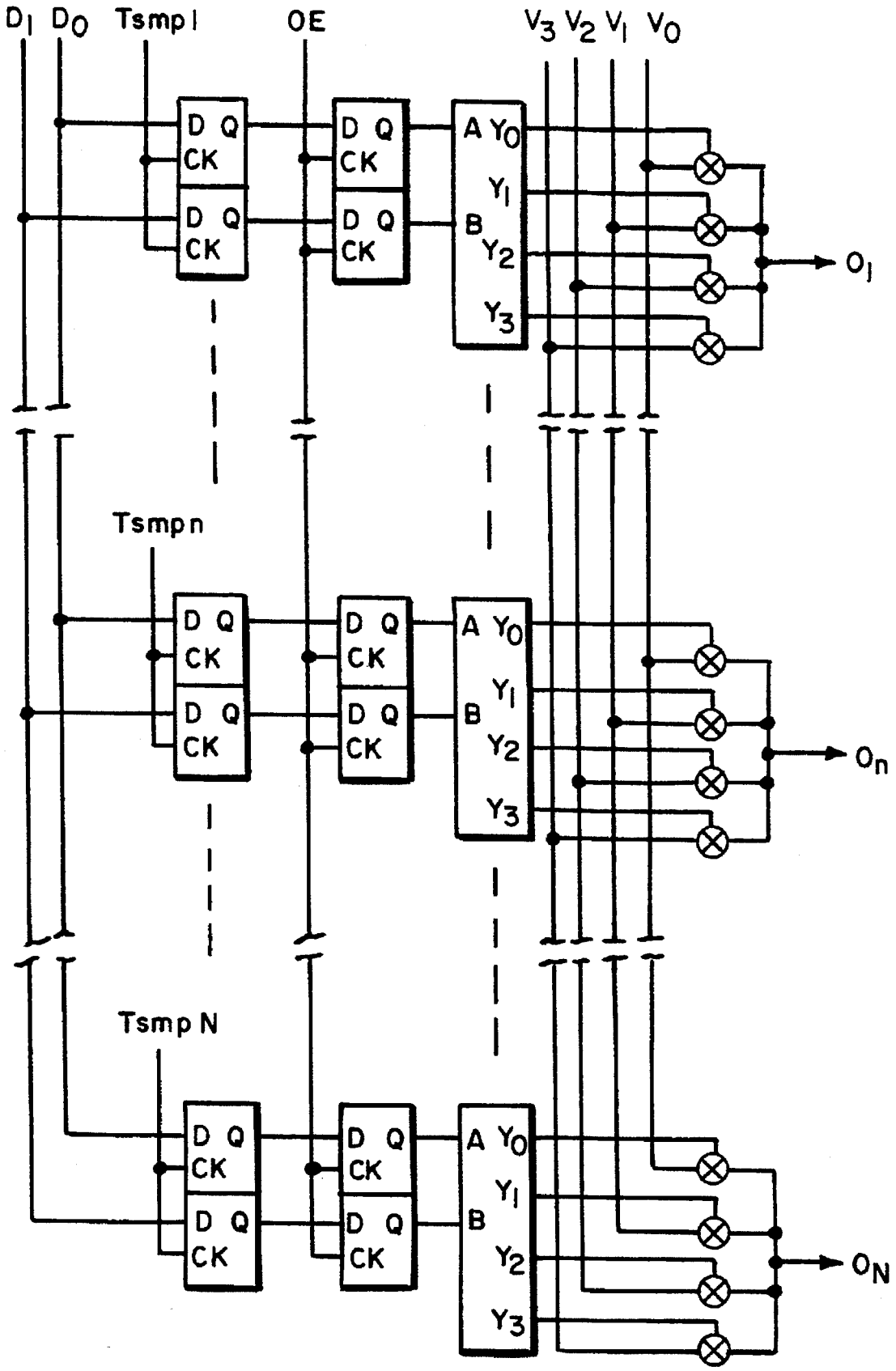
FIG. 1 is a schematic diagram showing the circuit of a conventional data driver.
Figure 2:
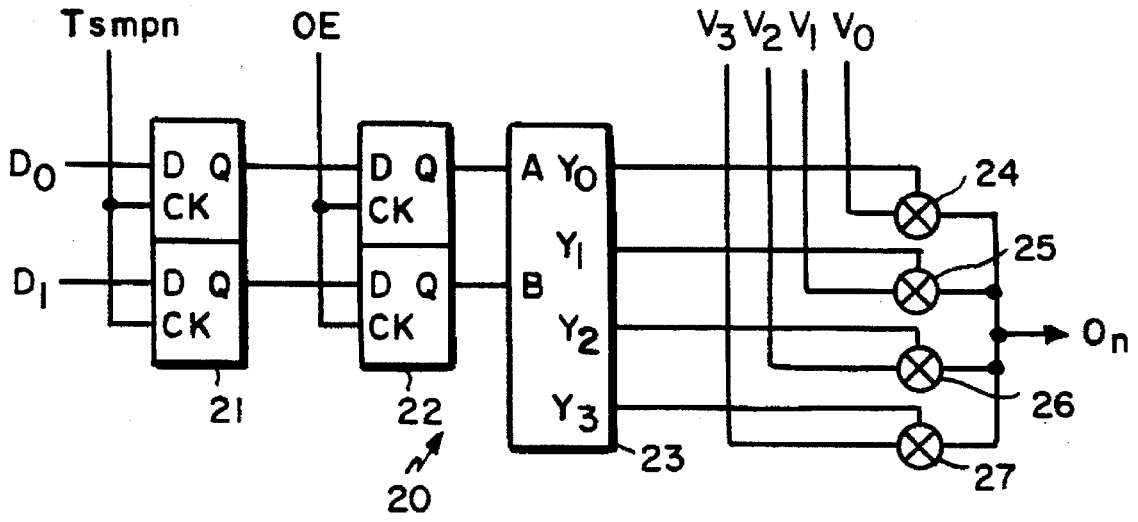
FIG. 2 is a schematic diagram showing a circuit which constitutes part of the conventional data driver of FIG. 1.
Figure 3:
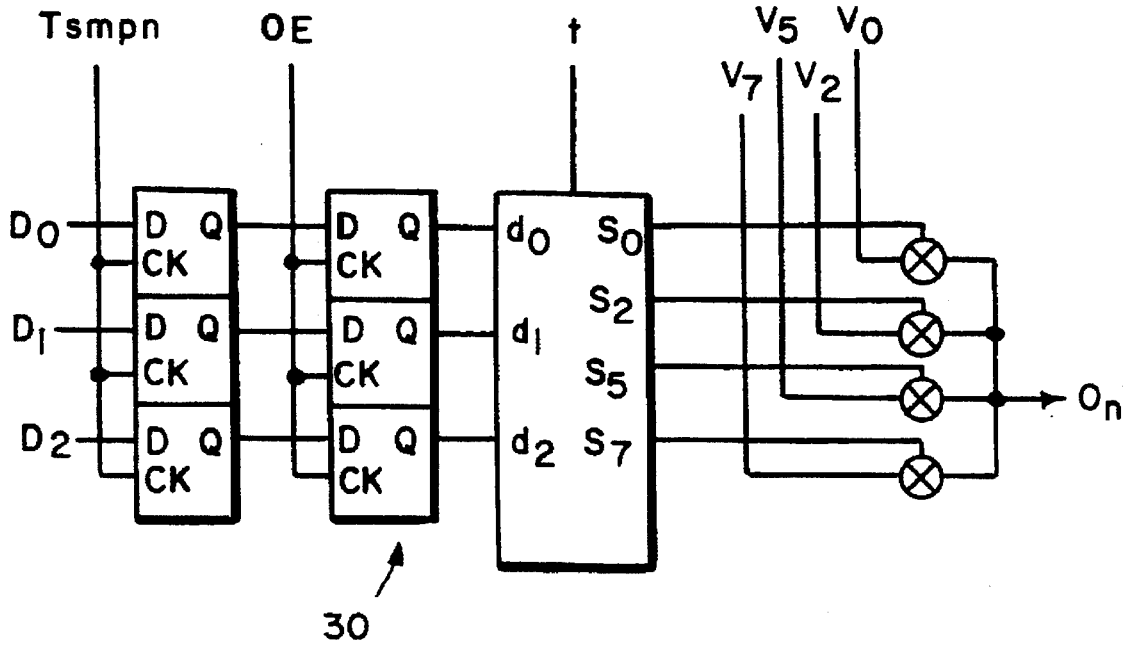
FIG. 3 is a schematic diagram showing a circuit which constitutes part of another conventional data driver.
Figure 4:
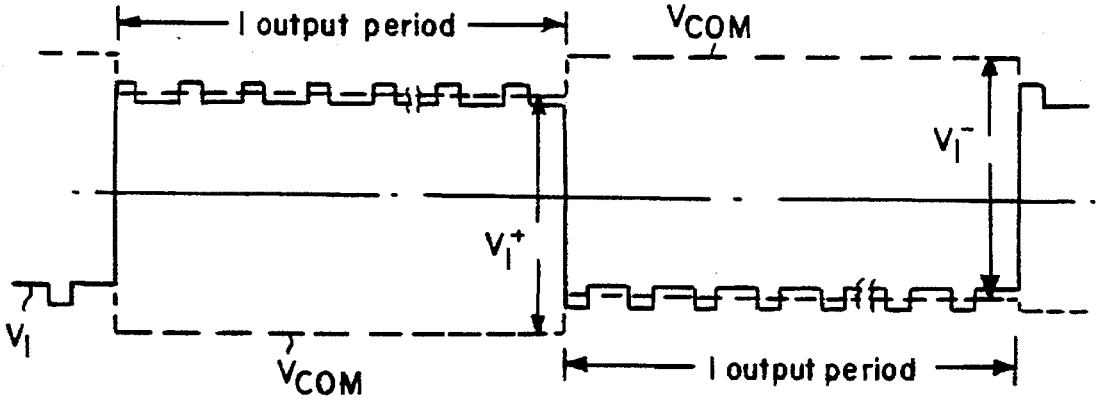
FIG. 4 shows the waveform of a signal voltage applied to a data line from the circuit 30 of FIG. 3, and the waveform of a voltage applied to a common electrode.
Figure 5:
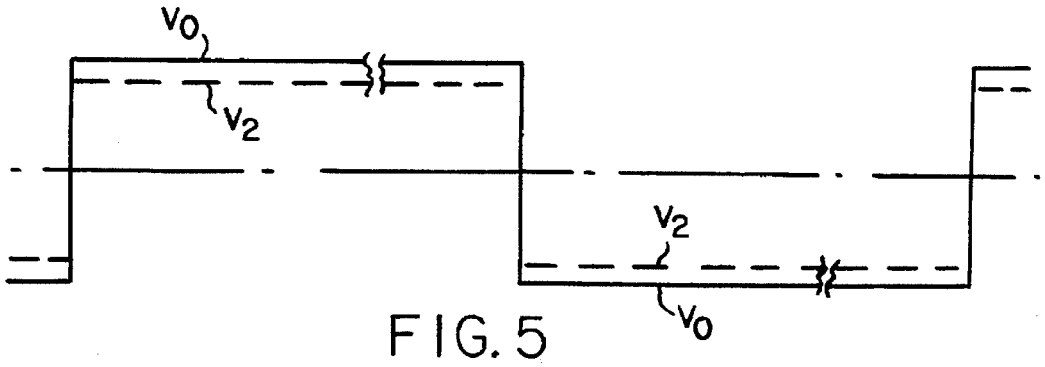
FIG. 5 shows the waveforms of gray-scale reference voltages $V_0$ and $V_2$.
Figure 7:
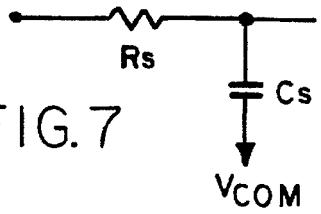
FIG. 7 is a schematic diagram showing an equivalent circuit of a data line which provides a load on a data driver.
Figure 8:
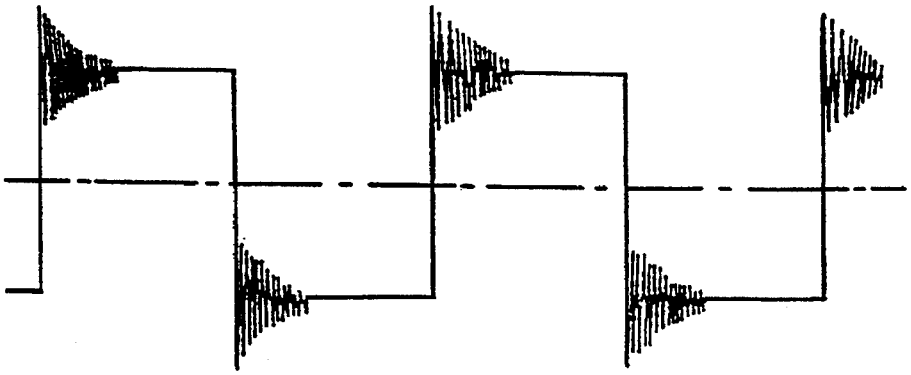
FIG. 8 shows the waveform of a gray-scale reference voltage $V_0$ supplied from a power supply circuit in which parasitic oscillation has occurred.
Figure 6:
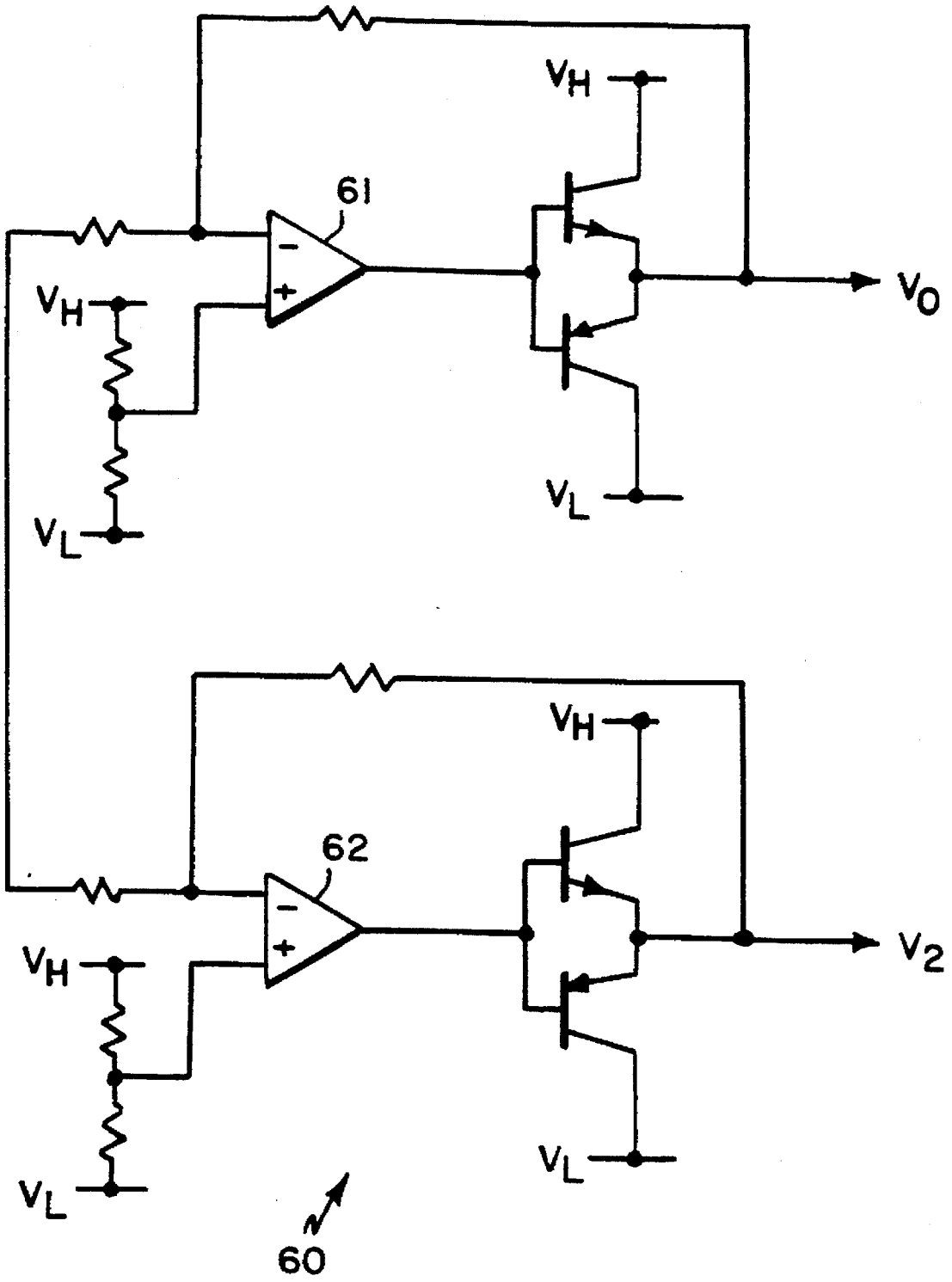
FIG. 6 is a schematic diagram showing a power supply circuit 60 for supplying the gray-scale reference voltages $V_0$ and $V_2$.

The circuit 120 includes sampling (primary) flip-flops 121 and holding (secondary) flip-flops 122 both for receiving and holding the respective bits of the digital image data ($D_0$, $D_1$, $D_2$). The circuit 120 also includes a selective control circuit 123, and four analog switches 124 to 127 to which voltages of different levels are respectively supplied. The selective control circuit 123 turns on or off the analog switches 124 to 127 individually to control the on/off state thereof in accordance with the received digital image data. The selective control circuit 123 receives a signal t' output from an AND circuit 128 to which signals t and c are input. The number of such AND circuits 128 required for the LSI circuit constituting the data driver 92 is, theoretically, only one. The reason for this is as follows: The data lines 96 are so designed as to provide equal loads. Accordingly, in all the power supply circuits for the data driver 92 (which power supply circuits are of the same type as, for example, the power supply circuit 60 shown in FIG. 6), substantially equal periods of time are required for high-level currents flowing therethrough at the beginning of one output period to decrease to their respective steady-state current levels. This results in that, in all the output terminals S(1) to S(N) of the data driver 92, necessary time intervals between the start of one output period and the start of the oscillating voltage supply can be made substantially equal (these time intervals will be described in detail later). Therefore, all the output terminals S(1) to S(N) are allowed to output oscillating voltages substantially at the same point of time in one output period. Since the timing of oscillating voltage supply is determined by using the signal t' output from the AND circuit 128 (as will be described later), all the N circuits 120 corresponding to the output terminals S(1) to S(N) of the data driver 92 can share the single AND circuit 128.

According to the invention, the signal c may be generated within the LSI circuit constituting the data driver 92, thereby preventing an increase in the number of terminals of the LSI circuit.

Next, the operation of the circuit 120 will be described with reference to FIG. 12. On receiving the leading edge of the sampling pulse $T_{smpn}$ corresponding to the "n"th pixel, the sampling flip-flops 121 obtain the respective bits of the digital image data ($D_0$, $D_1$, $D_2$) and hold the thus obtained data therein. This sampling process is performed for all the N pixels connected to one of the scanning lines 97 (the "j"th scanning line), respectively by all the N circuits 120 of the data driver 92. At the time when such sampling of image data for all the N pixels connected to the single scanning line 97 (i.e., sampling corresponding to one horizontal period) is completed, an output pulse OE is applied to the holding flip-flops 122. On receiving the output pulse OE, the holding flip-flops 122 obtain the digital image data ($D_0$, $D_1$, $D_2$) from the sampling flip-flops 121, and also output the received digital image data to the selective control circuit 123. The selective control circuit 123 is provided with input terminals $d_0$, $d_1$ and $d_2$, and output terminals $S_0$, $S_2$, $S_5$ and $S_7$. The three bits of the digital image data ($D_0$, $D_1$, $D_2$) are respectively input through the input terminals $d_0$, $d_1$ and $d_2$ to the selective control circuit 123. Through the output terminals $S_0$, $S_2$, $S_5$ and $S_7$, the selective control circuit 123 outputs control signals respectively for turning on or off the analog switches 124 to 127 so as to control the on/off state thereof. Gray-scale reference voltages $V_0$, $V_2$, $V_5$ and $V_7$ of different voltage levels are supplied to the four analog switches 124 to 127, respectively. Each of these voltages is output to the data line 96 only when the corresponding analog switch 124, 125, 126 or 127 is on. The relationship among the levels of these voltages is: $V_0<V_2<V_5<V_7$ or $V_7<V_5<V_2<V_0$. As a circuit for supplying such voltages, for example, the power supply circuit 60 shown in FIG. 6 can be used as described above.

Table 1 is a logical table showing the relationship between inputs and outputs of the selective control circuit 123. The first section of Table 1 (i.e., the first three columns from the left) show the values of the three bits of digital image data which are respectively input to the input terminals $d_2$, $d_1$ and $d_0$ of the selective control circuit 123. The second section of Table 1 (i.e., the next four columns) show the values of control signals which are respectively output from the output terminals $S_0$, $S_2$, $S_5$ and $S_7$ of the selective control circuit 123. Each of the analog switches 124 to 127 is turned on when receiving a control signal with a value of 1 from the output terminal $S_0$, $S_2$, $S_5$ or $S_7$ connected thereto, and turned off when receiving a control signal with a value of 0. Each of the blanks in the second section of Table 1 indicates that the value of the control signal is 0. Each "t'" indicates that the control signal has a value of 1 when the value of the signal t' is 1, and that the control signal has a value of 0 when the value of the signal t' is 0. Conversely, each $\bar{t}'$ indicates that the control signal has a value of 0 when the value of the signal t' is 1, and that the control signal has a value of 1 when the value of the signal t' is 0.

TABLE 1

| $d_2$ | $d_1$ | $d_0$ | $S_0$ | $S_2$ | $S_5$ | $S_7$ |
|---|---|---|---|---|---|---|
| 0 | 0 | 0 | 1 | | | |
| 0 | 0 | 1 | $\bar{t}'$ | t' | | |
| 0 | 1 | 0 | | 1 | | |
| 0 | 1 | 1 | | t' | $\bar{t}'$ | |
| 1 | 0 | 0 | | $\bar{t}'$ | t' | |
| 1 | 0 | 1 | | | 1 | |
| 1 | 1 | 0 | | | t' | $\bar{t}'$ |
| 1 | 1 | 1 | | | | 1 |

Figure 13:
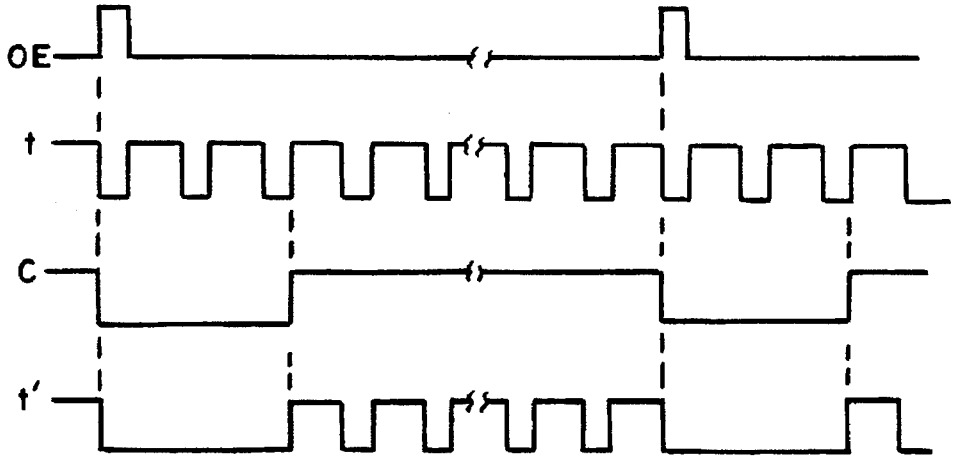
FIG. 13 shows the waveforms of an output pulse signal OE and signals t, c and t'.

FIG. 13 shows the waveforms of the above-described output pulse signal OE, and signals t, c and t'. The signal t is a pulse signal which periodically alternates between the values of 0 and 1 with a duty ratio of 1:2. Specifically, the ratio of the time for the signal t having a value of 0 to that for the signal t having a value of 1 is 1:2. The signal c is a pulse signal which is kept at a value of 0 only for a predetermined period of time from the rise of each output pulse OE. In other words, the value of the pulse signal c is kept at 0 only for a predetermined time period from the beginning of one output period, and then changes to 1 so that it is kept at 1 during the remaining part of the output period. According to the invention, the signal c may be generated from the output pulse signal OE. Since the signal t' is an output from the AND circuit 128 which receives the signals t and c as its inputs, the signal t' is kept at a value of 0 during the above-mentioned predetermined time period from the beginning of one output period, and is then changed into a pulse signal identical to the signal t and remains unchanged until the start of the next output period.

Next, the operation of the selective control circuit 123 will be described with reference to Table 1.

In the case where all the three bits respectively input to the input terminals $d_2$, $d_1$ and $d_0$ of the selective control circuit 123 have a value of 0, a control signal with a value of 1 is output from the output terminal $S_0$, thereby turning on the analog switch 124 connected thereto. The other analog switches 125 to 127 remain off. Thus, the voltage $V_0$ is output to the data line 96.

In the case where the values of the three bits input to the input terminals $d_2$, $d_1$ and $d_0$ are 0, 0 and 1, respectively, the control signals output from the output terminals $S_0$ and $S_2$ have the values of the signal $\bar{t}'$ and of the signal t', respectively. During the predetermined time period from the rise of each output pulse OE, the value of the signal $\bar{t}'$ is kept at 0 as described above, so that the value of the t' is kept at 1. Therefore, during this time period, the output terminal $S_0$ outputs a control signal with a value of 1, thereby turning on the analog switch 124 to keep it in the on state. The other analog switches 125 to 127 remain off. Thus, the voltage $V_0$ alone is output to the data line 96 during the predetermined time period from the beginning of the output period. Thereafter, as described above, the signal t' is changed into a pulse signal identical to the signal t, so that the value thereof alternates between 0 and 1 during the remaining part of the output period. When the signal t' has a value of 1, the analog switch 125 connected to the output terminal $S_2$ is turned on, with the other analog switches off, thereby allowing the voltage $V_2$ to be output to the data line 96. When the signal t' has a value of 0, the value of the $\bar{t}'$ becomes 1, so that the analog switch 124 connected to the output terminal $S_0$ is turned on with the other analog switches off, thereby allowing the voltage $V_0$ to be output to the data line 96. As a result, the signal voltage which is output from the circuit 120 to the data line 96 becomes an oscillating voltage which oscillates between the voltages $V_0$ and $V_2$ in the same cycle as that of the pulse signal t'.

Figure 14:
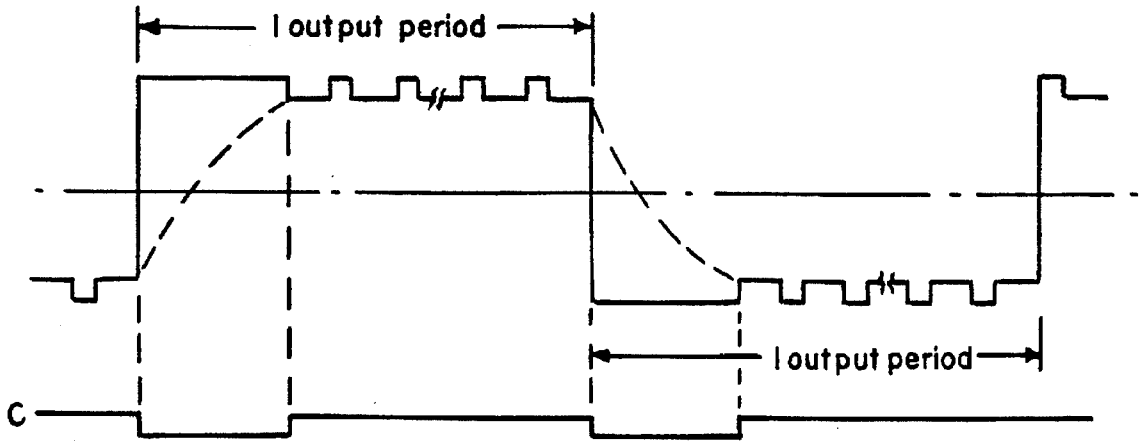
FIG. 14 shows the waveform of a signal voltage which is output to a data line 96 from the circuit of FIG. 12.

FIG. 14 shows the waveform of a signal voltage output from the circuit 120 of FIG. 12 to the corresponding data line 96. As described above, the circuit 120 outputs only the voltage $V_0$ to the data line 96 for a predetermined time period from the beginning of one output period. Alternatively, the voltage $V_2$ alone may be output to the data line 96 during this predetermined time period. In FIG. 14, the solid line represents the waveform of the signal voltage obtained on the assumption that the entire driving circuit operates on the ideal condition of no load. The broken lines represent changes in the potential of the data line 96 under the actual load provided by the liquid crystal panel. As shown in FIG. 14, a non-oscillating voltage (i.e., only the voltage $V_0$ or $V_2$) is supplied to the data line 96 from the beginning of one output period until the potential of the data line 96 reaches the level of the output signal voltage. Therefore, no parasitic oscillation arises in the power supply circuit 60.

FIG. 14 also shows the signal c for comparison. The period of time during which the signal c is kept at a value of 0 can be changed so as to adjust the time interval between the start of one output period and the start of oscillating voltage supply.

In the example described above, the data driver 92 starts to output an oscillating voltage after the potential of the data line 96 has reached approximately the level of the output signal voltage, thereby preventing parasitic oscillation from arising in the power supply circuit 60. According to the invention, however, even before the potential of the data line 96 reaches the output voltage level, the supply of oscillating voltage may be allowed to start as long as the transient state of the driving circuit has been changed into a substantially steady state. At the end of the transient state, the current reaches a lower level and the degree of decrease in the current level becomes small. At this time also, the supply of oscillating voltage may be allowed to start; this timing of oscillating voltage supply also makes it possible to prevent parasitic oscillation from arising in the power supply circuit 60. For example, it has been found that the sufficient effect of preventing parasitic oscillation can be obtained by starting the supply of oscillating voltage at the time when the current flowing through the power supply circuit 60 decreases to about ¼ of its peak current level.

The necessary time interval between the start of one output period and the start of oscillating voltage supply depends on the characteristics of a liquid crystal panel serving as a load and of a power supply circuit. Thus, the point of time at which the supply of oscillating voltage is allowed to start may vary over a certain range of time.

As described above, according to the invention, while the driving circuit is in a transient state in the initial part of each output period, non-oscillating signal voltages are output to the signal lines (i.e., the data lines described above), so that parasitic oscillation can be prevented from arising in the power supply circuit. Accordingly, the stable operation of the power supply circuit can be assured, thereby preventing increase in power consumption and generation of heat in the power supply circuit.

Also as described above, according to the invention, oscillating voltages are output to the signal lines after the elapse of a predetermined time period from the beginning of one output period, i.e., after the driving circuit has changed from its transient state to a substantially steady state. Therefore, a plurality of interpolated voltages (i.e., the oscillating voltages described above) can be obtained from gray-scale reference voltages by the oscillating voltage driving method without causing any unnecessary parasitic oscillation.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for driving a display apparatus which includes a display section including pixels and switching elements respectively connected to the pixels, and also includes a driving circuit for driving the display section, data signal lines connecting the switching elements to the driving circuit, and scanning lines provided orthogonally with said data signal lines and connected to said switching elements, said pixels being allowed to produce a display image by specific voltages applied thereto during an output period, and said output period being a time period during which one of said scanning lines is selected so that the switching elements connected to said selected scanning line are kept in an ON state, wherein said method includes the steps of:

allowing said driving circuit to output a non-oscillating voltage signal to each of said data signal lines for a predetermined time period from the start of said output period, said non-oscillating voltage signal having a predetermined constant non-zero voltage level during said predetermined time period; and allowing said driving circuit to output an oscillating voltage signal to each of said data signal lines from the end of said predetermined time period until the end of said output period, said oscillating voltage signal including at least one oscillating component.

2. A method according to claim 1, wherein said predetermined time period includes a period of time during which said driving circuit remains in a transient state, the transient state of the driving circuit arising at the start of said output period.

3. A method according to claim 2, wherein said predetermined time period ends with respect to each of said data signal lines at a timing when a potential of said each data signal line reaches a level of an output signal voltage.

4. A method according to claim 2, wherein said predetermined time period ends with respect to each of said data signal lines at a timing when a current flowing through the driving circuit decreases to about ¼ of its peak current level.

5. A method according to claim 1, wherein said oscillating voltage signal periodically oscillates between a first voltage and a second voltage.

6. A method according to claim 1, wherein said specific voltages are gray scale voltages.

7. A driving circuit for a display apparatus which includes a display section including pixels and switching elements respectively connected to the pixels, and also includes data signal lines connected to the switching elements, and scanning lines provided orthogonally with said data signal lines and connected to said switching elements, said pixels being allowed to produce a display image by specific voltages applied thereto during an output period, and said output period being a time period during which one of said scanning lines is selected so that the switching elements connected to said selected scanning line are kept in an ON state, wherein said driving circuit includes:

a voltage signal output means for outputting a non-oscillating voltage signal to each of said data signal lines for a predetermined time period from the start of said output period, said non-oscillating voltage signal having a predetermined constant non-zero voltage level during said predetermined time period, and then outputting an oscillating voltage signal to each of said data signal lines from the end of said predetermined time period until the end of said output period, said oscillating voltage signal including at least one oscillating component.

8. A driving circuit according to claim 7, wherein said predetermined time period includes a period of time during which said driving circuit remains in a transient state, the transient state of the driving circuit arising at the start of said output period.

9. A driving circuit according to claim 8, wherein said predetermined time period ends with respect to each of said data signal lines at a timing when a potential of said each data signal line reaches a level of an output signal voltage.

10. A driving circuit according to claim 8, wherein said predetermined time period ends with respect to each of said data signal lines at a timing when a current flowing through the driving circuit decreases to about ¼ of its peak current level.

11. A driving circuit according to claim 7, wherein said oscillating voltage signal periodically oscillates between a first voltage and a second voltage.

12. A driving circuit according to claim 7, wherein said voltage signal output means includes:

a plurality of switching means; and a selective control circuit for receiving digital image data and then turning on or off said switching means individually to control the on/off state thereof in accordance with the received digital image data, and wherein said switching means allow, only when they are turned on, different voltage signals respectively supplied thereto to be delivered to each of said data signal lines, and said selective control circuit turns on one of said switching means to keep said switching means in the on state during said predetermined time period, and then controls the on/off state of at least one pair of said switching means to alternately turning them on from the end of said predetermined time period until the end of said output period.

13. A driving circuit for according to claim 7, wherein said specific voltages are gray scale voltages.

* * * * *